US005947427A

United States Patent [19]

Holmquist

[11] Patent Number: 5,947,427

[45] Date of Patent: Sep. 7, 1999

[54] BABY FEEDING APPARATUS

[76] Inventor: Lonnie D. Holmquist, 1810 Webster Square #2, Hudson, Wis. 54016

[21] Appl. No.: 08/966,620

[22] Filed: Nov. 10, 1997

[51] Int. Cl.[6] ..... A47D 15/00

[52] U.S. Cl. ..... 248/102; 215/11.1; 215/11.5; 248/105

[58] Field of Search ..... 215/11.5, 11.1, 215/4, 5; 248/102, 105, 346.03, 346.01

[56] References Cited

U.S. PATENT DOCUMENTS

| | | | |
|---|---|---|---|
| 3,584,818 | 6/1971 | Essman | 248/105 |
| 4,744,476 | 5/1988 | McKee | 215/11.1 |
| 4,869,381 | 9/1989 | Agner | 215/11.1 |
| 5,078,155 | 1/1992 | Grandel | 248/105 |
| 5,358,476 | 10/1994 | Wilson | 604/74 |
| 5,509,687 | 4/1996 | Throndike | 280/766.1 |
| 5,577,692 | 11/1996 | Rollins | 248/106 |
| 5,725,189 | 3/1998 | Landy | 248/205.2 |

*Primary Examiner*—Leslie A. Braun
*Assistant Examiner*—Kimberly T. Wood

[57] ABSTRACT

A baby feeding apparatus comprised of a circular breast portion having a flat lower portion and a rounded upper portion. The flat lower portion has a recess formed in a center portion thereof. The rounded upper portion is removably secured to the flat lower portion. The closed rounded top has an upwardly extending externally threaded through hole. A spring-biased pressure plate has a spring portion secured within the recess formed in the flat lower portion of the circular breast portion. A milk bag having an opening therein is coupled with a top surface of the spring-biased pressure plate. The opening in the milk bag extends outwardly of the through hole in the rounded upper portion of the circular breast portion. A nipple portion is adapted for removable securement to the upwardly extending through hole in the rounded upper portion of the circular breast portion. The upper nipple is adapted to a baby's mouth for receiving milk therethrough.

5 Claims, 4 Drawing Sheets

PRIOR ART

BABY FEEDING APPARATUS

BACKGROUND OF THE INVENTION

1. Field of the Invention

The present invention relates to a baby feeding apparatus and more particularly pertains to permitting a child to assume a more natural position while nursing with a baby feeding apparatus.

2. Description of the Prior Art

The use of infant nursing devices is known in the prior art. More specifically, infant nursing devices heretofore devised and utilized for the purpose of feeding infants are known to consist basically of familiar, expected and obvious structural configurations, notwithstanding the myriad of designs encompassed by the crowded prior art which have been developed for the fulfillment of countless objectives and requirements.

By way of example, U.S. Pat. No. 5,263,599 to Sklar discloses an infant nursing device.

U.S. Pat. No. 5,137,183 to Mikulec et al. discloses a compressible feeding apparatus.

U.S. Pat. No. 4,793,533 to Yang discloses an intimacy-promoting baby feed bottle.

U.S. Pat. No. 4,744,476 to McKee discloses a collapsible infant feeding bottle.

U.S. Pat. No. 3,493,139 to Faddoul et al. discloses an infant feeding device.

In this respect, the baby feeding apparatus according to the present invention substantially departs from the conventional concepts and designs of the prior art, and in doing so provides an apparatus primarily developed for the purpose of permitting a child to assume a more natural position while nursing.

Therefore, it can be appreciated that there exists a continuing need for new and improved baby feeding apparatus which can be used for permitting a child to assume a more natural position while nursing. In this regard, the present invention substantially fulfills this need.

SUMMARY OF THE INVENTION

In the view of the foregoing disadvantages inherent in the known types of infant nursing devices now present in the prior art, the present invention provides an improved baby feeding apparatus. As such, the general purpose of the present invention, which will be described subsequently in greater detail, is to provide a new and improved baby feeding apparatus and method which has all the advantages of the prior art and none of the disadvantages.

To attain this, the present invention essentially comprises a cushion having a foamed inner layer, a cotton-blended outer layer, an inclined upper surface, a flat lower surface, a rear wall, and two side walls. The inclined upper surface has a recess formed therein extending outwardly of the rear wall. The cushion has a head rest removably secured thereto adjacent to the recess formed therein. The device contains a circular breast portion having a flat lower portion and a rounded upper portion. The flat lower portion is secured within the recess formed in the cushion. The flat lower portion has a threaded portion extending upwardly from an outer periphery thereof. The flat lower portion has a recess formed in a center portion thereof. The rounded upper portion has an open bottom and a closed rounded top. The open bottom is internally threaded. The open bottom is removably secured to the threaded portion of the flat lower portion. The closed rounded top has an upwardly extending externally threaded through hole. The device contains a spring-biased pressure plate having two end portions and an intermediate portion therebetween. The spring-biased pressure plate has a spring portion. The spring portion has a first end and a second end. The first end is secured to a lower surface of the intermediate portion of the spring-biased pressure plate. The second end is secured within the recess formed in the flat lower portion of the circular breast portion. The device contains a milk bag having an opening therein. The milk bag is coupled with a top surface of the spring-biased pressure plate. The opening in the milk bag extends outwardly of the through hole in the rounded upper portion of the circular breast portion. The device contains a nipple portion having an open lower securement portion and an upper nipple. The open lower securement portion is internally threaded. The open lower securement portion is adapted for removable securement to the upwardly extending externally threaded through hole in the rounded upper portion of the circular breast portion. The upper nipple is adapted to a baby's mouth for receiving milk therethrough.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved baby feeding apparatus which has all the advantages of the prior art infant nursing devices and none of the disadvantages.

It is another object of the present invention to provide a new and improved baby feeding apparatus which may be easily and efficiently manufactured and marketed.

It is a further object of the present invention to provide a new and improved baby feeding apparatus which is of durable and reliable construction.

An even further object of the present invention is to provide a new and improved baby feeding apparatus which is susceptible of a low cost of manufacture with regard to both materials and labor, and which accordingly is then susceptible of low prices of sale to the consuming public, thereby making such a baby feeding apparatus economically available to the buying public.

Still yet another object of the present invention is to provide a new and improved baby feeding apparatus which provides in the apparatuses and methods of the prior art some of the advantages thereof, while simultaneously overcoming some of the disadvantages normally associated therewith.

Still another object of the present invention is to provide a new and improved baby feeding apparatus for permitting a child to assume a more natural position while nursing.

Lastly, it is an object of the present invention to provide a new and improved baby feeding apparatus comprised of a circular breast portion having a flat lower portion and a rounded upper portion. The flat lower portion has a recess formed in a center portion thereof. The rounded upper portion is removably secured to the flat lower portion. The closed rounded top has an upwardly extending externally threaded through hole. A spring-biased pressure plate has a spring portion secured within the recess formed in the flat lower portion of the circular breast portion. A milk bag having an opening therein is coupled with a top surface of the spring-biased pressure plate. The opening in the milk bag extends outwardly of the through hole in the rounded upper portion of the circular breast portion. A nipple portion is adapted for removable securement to the upwardly extending through hole in the rounded upper portion of the circular breast portion. The upper nipple is adapted to a baby's mouth for receiving milk therethrough.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various Figures.

DESCRIPTION OF THE PREFERRED EMBODIMENT

Figure 1:
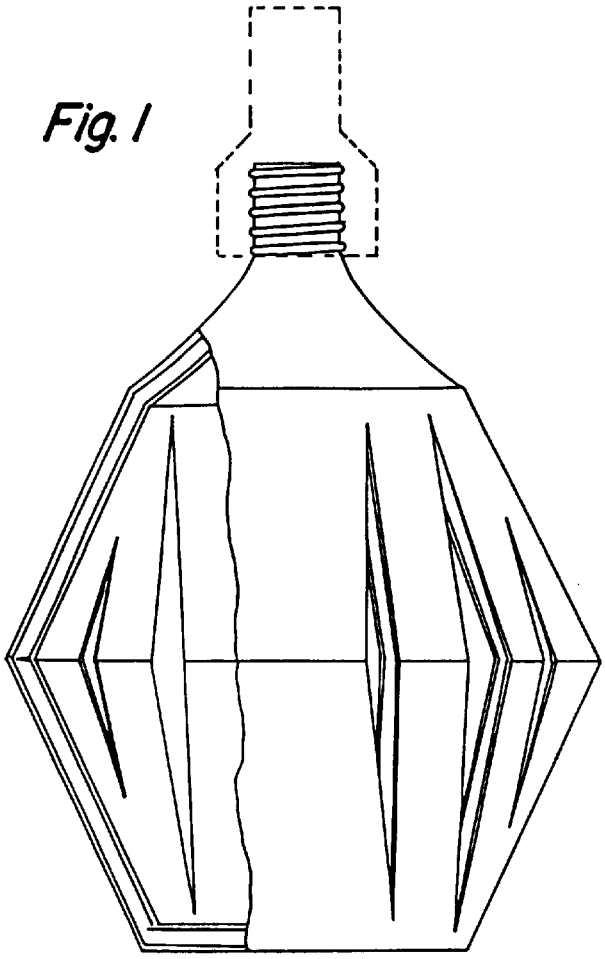
FIG. 1 is a front view of the prior art collapsible infant feeding device.
Figure 2:
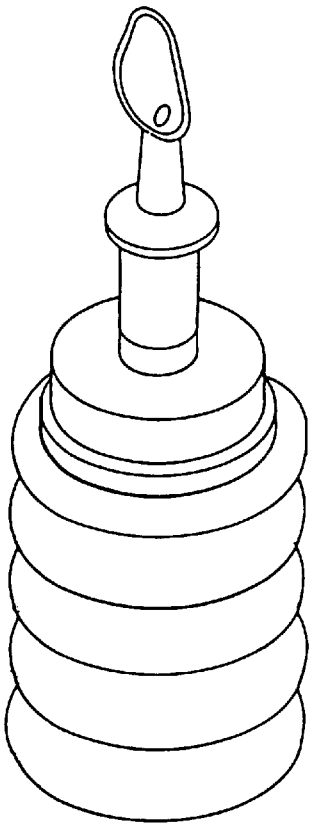
PRIOR ART Fig. 2
FIG. 2 is a perspective view of the prior art compressible feeding apparatus.
Figure 3:
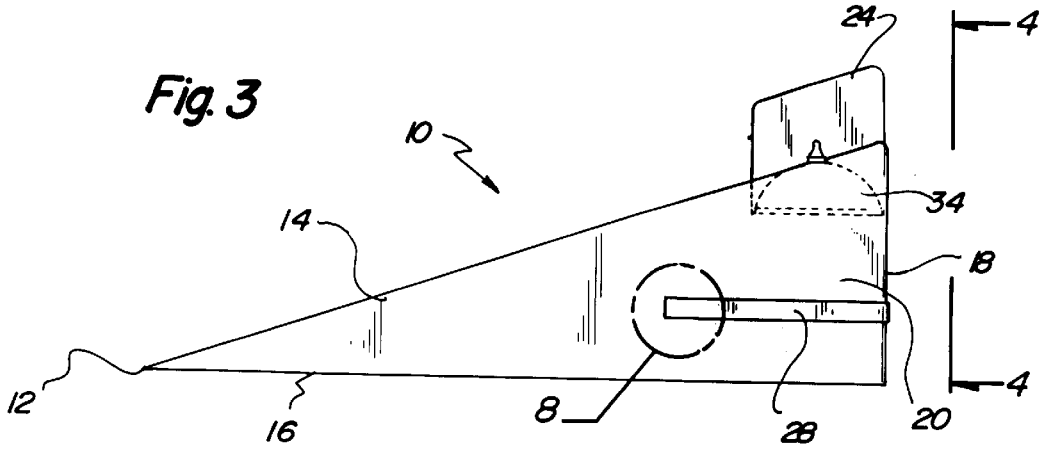
FIG. 3 is a side view of the preferred embodiment of the baby feeding apparatus constructed in accordance with the principles of the present invention.
Figure 4:
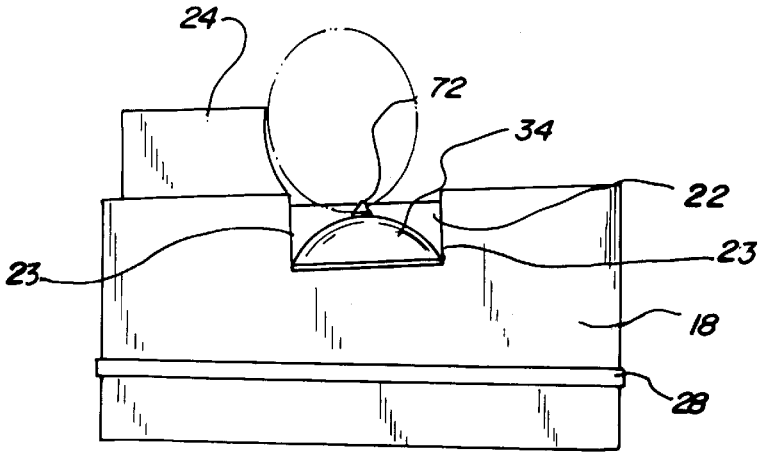
FIG. 4 is a rear elevation view of the present invention.
Figure 5:
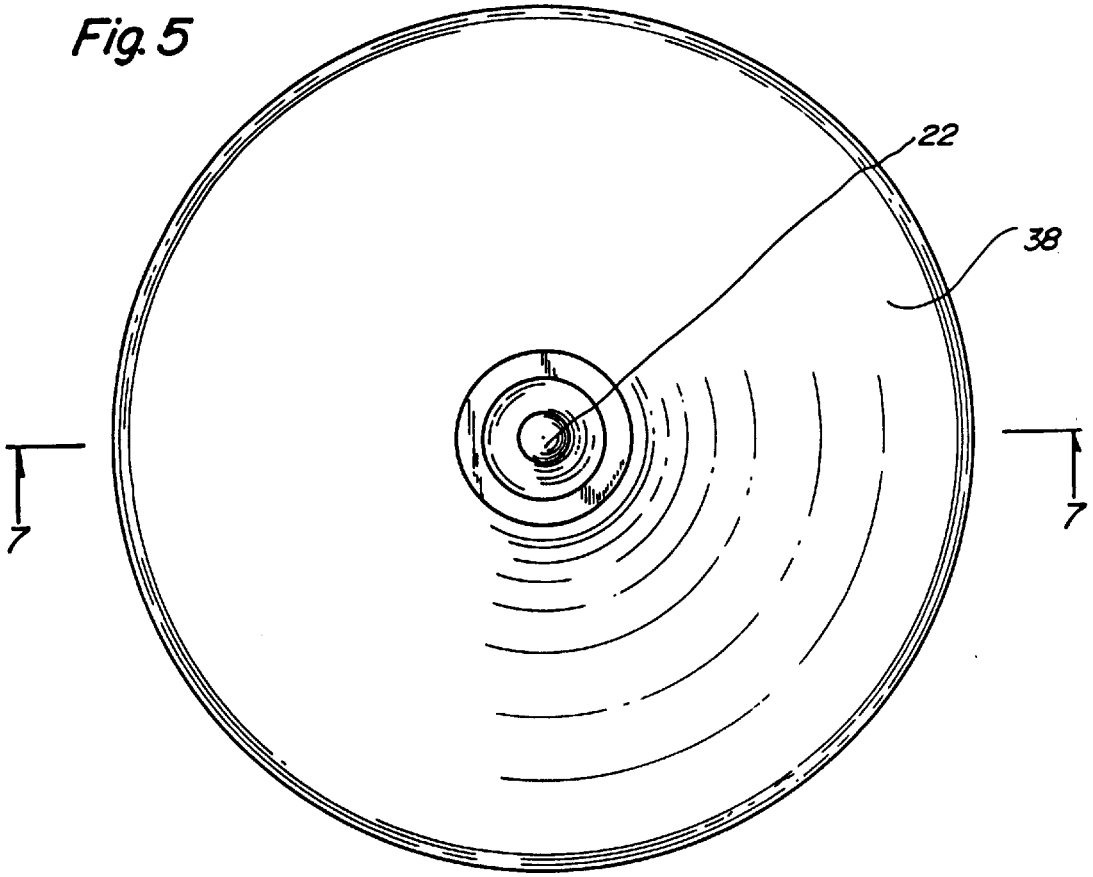
FIG. 5 is a plan view of the nipple of the present invention.
Figure 6:
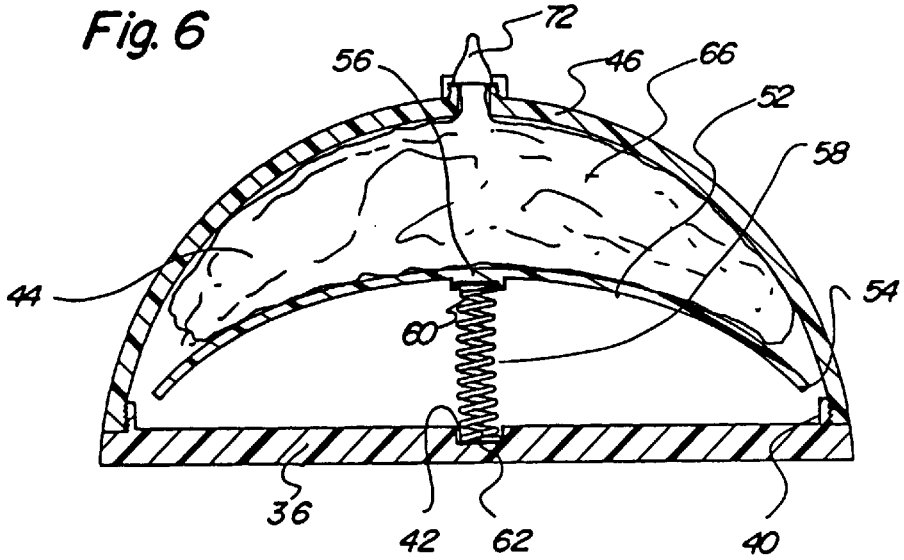
FIG. 6 is a cross-sectional view of the breast of the present invention.
Figure 7:
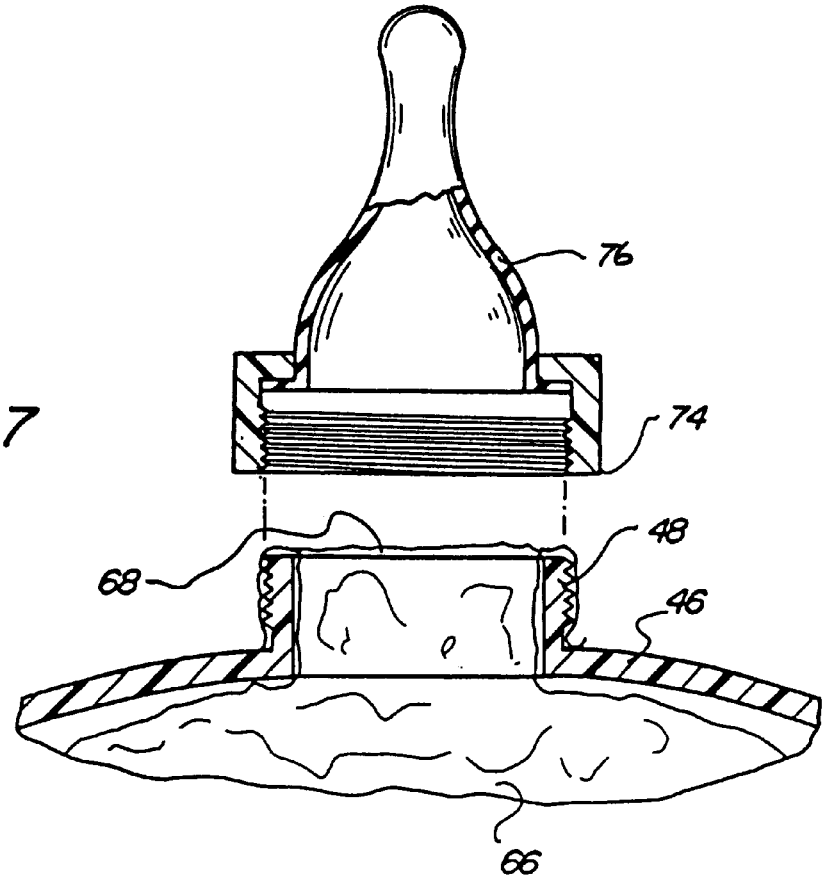
FIG. 7 is a cross-sectional view as taken along line 7—7 of FIG. 5.
Figure 8:
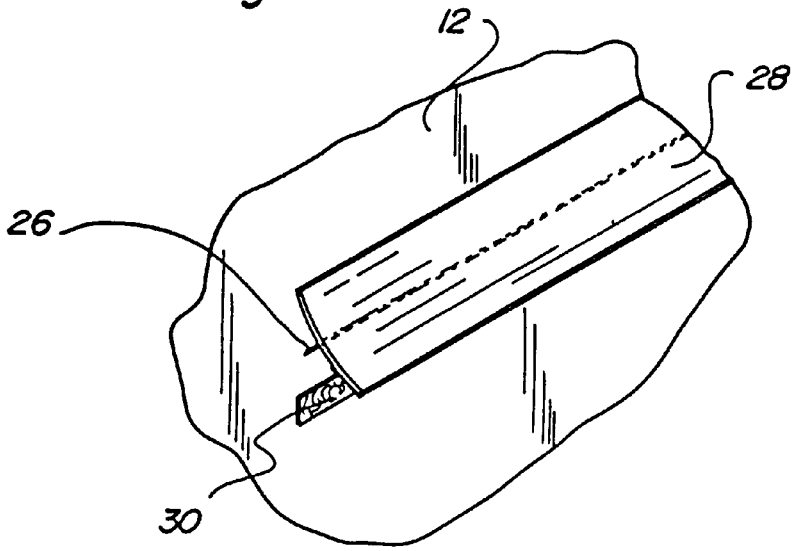
FIG. 8 is a fragmentary view of the slot within the cushion of the present invention.

With reference now to the drawings, and in particular, to FIGS. 3–8 thereof, the preferred embodiment of the new and improved baby feeding apparatus embodying the principles and concepts of the present invention and generally designated by the reference number 10 will be described.

Specifically, it will be noted in the various Figures that the device relates to a new and improved baby feeding apparatus for permitting a child to assume a more natural position while nursing. In its broadest context, the device consists of a cushion, a circular breast portion, a spring-biased pressure plate, a milk bag, and a nipple portion.

The device 10 contains a cushion 12 having a foamed inner layer, a cotton-blended outer layer, an inclined upper surface 14, a flat lower surface 16, a rear wall 18, and two side walls 20. The inclined upper surface 14 has a recess 22 formed therein extending outwardly of the rear wall 18. The cushion 12 has a head rest 24 removably secured thereto adjacent to the recess 22 formed therein. The head rest 24 is optionally attached to the cushion 12 by a hook and loop type fastener. The cotton-blended outer layer of the cushion 12 could be incorporated with a horizontal opening 26 extending from one of the two side walls 23 around the rear wall 18 to the opposing side wall 23. The horizontal opening 26 would allow the foamed inner layer to be removed thereby allowing the cotton-blended outer layer to be washed and cleaned. The cotton-blended outer layer could also have a flap portion 28 incorporated into the device 10 to cover the horizontal opening 26. The flap portion 28 would have a strip of hook and loop type fasteners 30 on its inner surface corresponding to a hook and loop type strip 30 adjacent to the horizontal opening 26 to allow the horizontal opening 26 to be accessed to remove the foamed inner layer. The outer layer is not limited to cotton-blend, but could be fabricated of other comfortable, washable materials.

The device 10 contains a circular breast portion 34 having a flat lower portion 36 and a rounded upper portion 38. The flat lower portion 36 is secured within the recess 22 formed in the cushion. The flat lower portion 36 has a threaded portion 40 extending upwardly from an outer periphery thereof. The flat lower portion 36 has a recess 42 formed in a center portion thereof. The rounded upper portion 38 has an open bottom 44 and a closed rounded top 46. The open bottom 44 is internally threaded. The open bottom 44 is removably secured to the threaded portion 40 of the flat lower portion 36. The closed rounded top 46 has an upwardly extending externally threaded through hole 48.

The device 10 contains a spring-biased pressure plate 52 having two end portions 54 and an intermediate portion 56 therebetween. The spring-biased pressure plate 52 has a spring portion 58. The spring portion 58 has a first end 60 and a second end 62. The first end 60 is secured to a lower surface of the intermediate portion 56 of the spring-biased pressure plate 52. The second end 62 is secured within the recess 42 formed in the flat lower portion 36 of the circular breast portion 34.

The device 10 contains a milk bag 66 having an opening 68 therein. The milk bag 66 is coupled with a top surface of the spring-biased pressure plate 52. The opening 68 in the milk bag 66 extends outwardly of the through hole 48 in the rounded upper portion 38 of the circular breast portion 34. To put the milk bag 66 in place, the rounded upper portion 38 is removed from the lower flat portion 36. The milk bag 66 is placed a top the spring-biased pressure plate 52 with the opening 68 in the milk bag aligned and extended within the through hole 48 in the rounded upper portion 38. The spring-biased pressure plate 52 pushes the milk bag 66 upwardly thereby causing milk to expel outwardly of the through hole 48. After the milk bag 66 is emptied, the process is simply reversed to remove the empty milk bag 66 and install a new one.

The device 10 contains a nipple portion 72 having an open lower securement portion 74 and an upper nipple 76. The open lower securement portion 74 is internally threaded. The open lower securement portion 74 is adapted for removable securement to the upwardly extending externally threaded through hole 48 in the rounded upper portion 38 of the circular breast portion 34. The upper nipple 72 is adapted to a baby's mouth for receiving milk therethrough. The nipple portion 72 prevents milk from expelling outwardly of the device 10 unless being sucked by a baby or child. The upper nipple 76 is constantly filled with milk from the milk bag 66 as the spring-biased pressure plate 52 is pushing the milk bag up towards the nipple portion 72. By positioning the baby or child on the cushion 12, allows the baby or child to feed from the upper nipple 76 in a prone position.

The present invention is a novel design for a baby bottle that permits the child to assume a more natural position while nursing, which greatly reduces the occurrence of the formula entering the eustachian tube and causing an ear infection. During use the conventional bottle has the baby in a supine, on their back, position. The milk runs down the back of their throats. The opening of the Eustachian tube is at the superior posterior part of the oralpharnyx. A small amount of milk may, while the baby is supine, reflux into this opening which is a direct channel to the inner ear. The milk is an excellent medium for bacterial growth. This may be the cause of increased ear infections in infants. The present invention is used by the baby in an upright to prone and on the stomach position. This is the more natural way the baby's throat was intended to be in while drinking.

It is made of a durable resilient plastic material, in the general shape of a mother's breast, or a simple dome. The bottom is flat, and has a removable breast portion 34 to permit accessing the interior chamber to replace the milk bag 66. A removable nipple portion 72 is located on the top of the breast portion 34 on a through hole 48 where the milk bag 66 attaches to the nipple portion 72. A spring-biased pressure plate 52 extends up from the inside of the bottom cover to apply pressure to the milk bag 66 of formula, forcing it to the top to keep the upper nipple full 76. The plate 52 is curved to match the inside of the top curved section of the nurser for optimal consumption of the contents.

This nurser is designed to be placed on a relatively flat surface with the nipple on the top. This allows the nursing child to lay prone or semi-prone, for a more natural positioning of the throat and esophagus, putting the opening of the eustachian tube above the flow of the formula.

Reduces the possibility of choking and ear infections that can be caused from liquids entering the inner ear. If the baby burps up or vomits, the fluid exits the mouth instead of collecting in the throat.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modification and changes will readily occur to those skilled in the art, it is not desired to limit the invention to the exact construction and operation shown and described, and accordingly, all suitable modification and equivalents may be resorted to, falling within the scope of the invention.

What is claimed as being new and desired to be protected by letters patent of the united states is as follows:

1. A baby feeding apparatus for permitting a child to assume a more natural position while nursing comprising, in combination:

a cushion having a foamed inner layer, a cotton-blended outer layer, an inclined upper surface, a flat lower surface, a rear wall, and two side walls, the inclined upper surface having a recess formed therein extending outwardly of the rear wall, the cushion having a head rest removably secured thereto adjacent to the recess formed therein;

a circular breast portion having a flat lower portion and a rounded upper portion, the flat lower portion secured within the recess formed in the cushion, the flat lower portion having a threaded portion extending upwardly from an outer periphery thereof, the flat lower portion having a recess formed in a center portion thereof, the rounded upper portion having an open bottom and a closed rounded top, the open bottom being internally threaded, the open bottom being removably secured to the threaded portion of the flat lower portion, the closed rounded top having an upwardly extending externally threaded through hole;

a spring-biased pressure plate having two end portions and an intermediate portion therebetween, the spring-biased pressure plate having a spring portion, the spring portion having a first end and a second end, the first end secured to a lower surface of the intermediate portion of the spring-biased pressure plate, the second end secured within the recess formed in the flat lower portion of the circular breast portion;

a milk bag having an opening therein, the milk bag coupled with a top surface of the spring-biased pressure plate, the opening in the milk bag extending outwardly of the through hole in the rounded upper portion of the circular breast portion;

a nipple portion having an open lower securement portion and an upper nipple, the open lower securement portion being internally threaded, the open lower securement portion being adapted for removable securement to the upwardly extending externally threaded through hole in the rounded upper portion of the circular breast portion, the upper nipple being adapted to be received in a baby's mouth for receiving milk therethrough.

2. A baby feeding apparatus for permitting a child to assume a more natural position while nursing comprising, in combination:

a circular breast portion having a flat lower portion and a rounded upper portion, the rounded upper portion having a closed rounded top, the flat lower portion having a recess formed in a center portion thereof, the rounded upper portion being removably secured to the flat lower portion, the closed rounded top having an upwardly extending externally threaded through hole;

a spring-biased pressure plate having a spring portion secured within the recess formed in the flat lower portion of the circular breast portion;

a milk bag having an opening therein, the milk bag coupled with a top surface of the spring-biased pressure plate, the opening in the milk bag extending outwardly of the through hole in the rounded upper portion of the circular breast portion;

a nipple portion being adapted for removable securement to the upwardly extending through hole in the rounded upper portion of the circular breast portion, the nipple portion having an upper nipple being adapted to be received in a baby's mouth for receiving milk therethrough.

3. The apparatus as described in claim 2 and further including a cushion having a foamed inner layer, a cotton-blended outer layer, an inclined upper surface, a flat lower surface, a rear wall, and two side walls, the inclined upper surface having a recess formed therein extending outwardly of the rear wall, the cushion having a head rest removably secured thereto adjacent to the recess formed therein, the recess in the cushion serving to store the flat lower portion of the circular breast portion therein.

4. The apparatus as described in claim 1 wherein the cotton-blended outer layer of the cushion having a horizontal opening extending from one of the two side walls around the rear wall to the opposing side wall, the opening allowing the foamed inner layer to be removed, the cotton-blended outer layer having a flap portion removably covering the horizontal opening.

5. The apparatus as described in claim 1 wherein the head rest of the cushion is removably secured to the cushion by hook and loop type fasteners.

* * * * *